US009975354B1

(12) United States Patent
Boland et al.

(10) Patent No.: US 9,975,354 B1
(45) Date of Patent: May 22, 2018

(54) CONCENTRIC DUCT SYSTEM FOR A DRYER FOR PRINTING SYSTEM

(71) Applicants: Stuart James Boland, Denver, CO (US); Scott Richard Johnson, Erie, CO (US)

(72) Inventors: Stuart James Boland, Denver, CO (US); Scott Richard Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/444,530

(22) Filed: Feb. 28, 2017

(51) Int. Cl.
*B41J 11/00* (2006.01)
*B41F 23/04* (2006.01)

(52) U.S. Cl.
CPC ..... *B41J 11/002* (2013.01); *B41F 23/04* (2013.01)

(58) Field of Classification Search
CPC ..... B41J 11/002; B41F 3/52; B41F 23/0403; B41F 23/0486; B41F 23/0423; B41F 23/0426
USPC ..... 347/102
See application file for complete search history.

(56) References Cited

U.S. PATENT DOCUMENTS 2,661,544 A 12/1953 Tanasse
3,659,352 A 5/1972 Cook
3,739,491 A * 6/1973 Creapo ..... F26B 13/10 34/229
3,859,735 A 1/1975 Katterjohn
3,874,091 A * 4/1975 Fukumoto ..... B41F 23/0426 34/652
4,779,355 A 10/1988 Petros
5,018,281 A 5/1991 Bulluck
5,152,080 A 10/1992 Wimberger
5,210,961 A 5/1993 Jacobs et al.
9,010,892 B2 4/2015 Frydman et al.
9,423,176 B1 8/2016 Girardi
2006/0199520 A1 9/2006 Chung et al.
2012/0233876 A1 9/2012 Weldon et al.
2014/0041251 A1 2/2014 Barreto
2014/0096409 A1 4/2014 Ohtsu et al.

* cited by examiner

*Primary Examiner* — Huan Tran
*Assistant Examiner* — Alexander D Shenderov
(74) *Attorney, Agent, or Firm* — Duft Bornsen & Fettig LLP

(57) ABSTRACT

Systems and methods for concentric duct system for a dryer of a printing system. One embodiment includes a dryer of a printing system and a duct system. The dryer includes web conditioners sources to condition a web of print media, intake ports to supply air for the web conditioners, and outlet ports to remove air for the web conditioners. The duct system includes a supply hub and a return hub. The supply hub includes a tubular body with a lower portion and an upper portion, and supply nodes around the lower portion. The return hub includes a body around the upper portion of the supply hub, and return nodes around the body. The duct system further includes supply ducts to connect the supply nodes and the intake ports, and return ducts to connect the return nodes and the outlet ports.

20 Claims, 9 Drawing Sheets

CONCENTRIC DUCT SYSTEM FOR A DRYER FOR PRINTING SYSTEM

FIELD OF THE INVENTION

The invention relates to the field of printing systems, and in particular, to dryers of printing systems.

BACKGROUND

Businesses or other entities having a need for volume printing typically use a production printing system capable of printing hundreds of pages per minute. A web of print media, such as paper, is stored the form of a large roll and unraveled as a continuous sheet. During printing, the web is quickly passed underneath printheads which discharge small drops of ink at particular intervals to form pixel images on the web. The web may then be dried and cut to produce a printed product.

Since production printers print high quality images at high speed, it is important that the drying process of the web is quick, effective, and efficient. Advanced dryers may be equipped with an array of heat sources (e.g., radiant energy sources, air knives, etc.) and thermally conductive surfaces (e.g., drum, rollers, etc.) to precisely control heat applied to the web. Due to the large amount of heat produced by the heat components (e.g., in excess of 100 degrees Celsius), typical climate control solutions such as localized direct current (DC) fans are insufficient for distributing and exhausting air inside the dryer. High performance drying applications therefore often use a duct system to supply/remove air and control the environment inside the dryer.

A high performance dryer system may require continual high velocity air used to accelerate the drying process coupled with localized air removal to prevent saturation of the air and condensation of volatiles in unwanted areas. A conventional duct system that enables this type of airflow includes an entangled network of flexible tube ducts that connect the airflow components inside the dryer to an air handling unit placed within the printing system or on the floor of the print shop outside the dryer. Each airflow component inside the dryer may connect with at least one tube duct for supply air and at least one tube duct for return air. Due to the large number of flexible tubes and the size of the air handling equipment, a relatively large distance between the dryer and air handling unit is necessary. This configuration operates inefficiently due to losses in heat transfer and pressure over the large distance, takes up a large amount of floor space in the print shop, and makes it difficult to service the dryer and its components for maintenance.

SUMMARY

Embodiments described herein provide a concentric duct system for a dryer of a printing system. The duct system includes a central hub with concentric supply/return plenums that are stacked with one on top of the other. The concentric, stacked configuration enables the central hub to be attached to a side of the dryer so that it does not take up floor space in the print shop. The configuration also enables the central hub to be located in close proximity to the air intake/return devices inside the dryer for higher operating efficiency. The duct system also includes easily removable ducts that connect around the concentric supply/return cabinets to supply/remove air from the airflow components inside the dryer.

One embodiment is a system that includes a dryer of a printing system and a duct system for the dryer. The dryer includes web conditioners configured to heat a web of print media, intake ports configured to supply air for the web conditioners, and outlet ports configured to remove air for the web conditioners. The duct system includes a supply hub and a return hub. The supply hub includes a tubular body with a lower portion and an upper portion, and supply nodes around the lower portion. The return hub includes a body around the upper portion of the supply hub, and return nodes around the body. The duct system further includes supply ducts configured to connect the supply nodes and the intake ports of the dryer, and return ducts configured to connect the return nodes and the outlet ports of the dryer.

Another embodiment is an apparatus that includes a supply hub including a tubular body with a lower portion and an upper portion, and including supply nodes around the lower portion. The supply hub configured to provide air to intake ports of a dryer applying airflow to a web of print media. The apparatus also includes a return hub including a body around the upper portion of the supply hub, and including return nodes around the body, the return hub configured to receive air from outlet ports of the dryer. The apparatus further includes supply ducts configured to connect the supply nodes of the supply hub and the intake ports of the dryer, and return ducts configured to connect the return nodes of the return hub and the outlet ports of the dryer.

Yet another embodiment is a system that includes a dryer of a printing system comprising: web conditioners configured to condition a web of print media, intake ports configured to supply air for the web conditioners, and outlet ports configured to remove air for the web conditioners. The system also includes a duct system for the dryer comprising: a supply hub with first air passages removably attached around a perimeter of the first hub configured to removably attach with the intake ports of the web conditioners, and a return hub with second air passages removably attached around a perimeter of the second hub configured to removably attach with the outlet ports of the web conditioners. The supply hub and the return hub are positioned concentrically with one another on a side of the dryer. In a further embodiment, the supply hub is stacked on top of an upper portion of the return hub. In an alternative further embodiment, the return hub is stacked on top of an upper portion of the supply hub.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number may represent the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
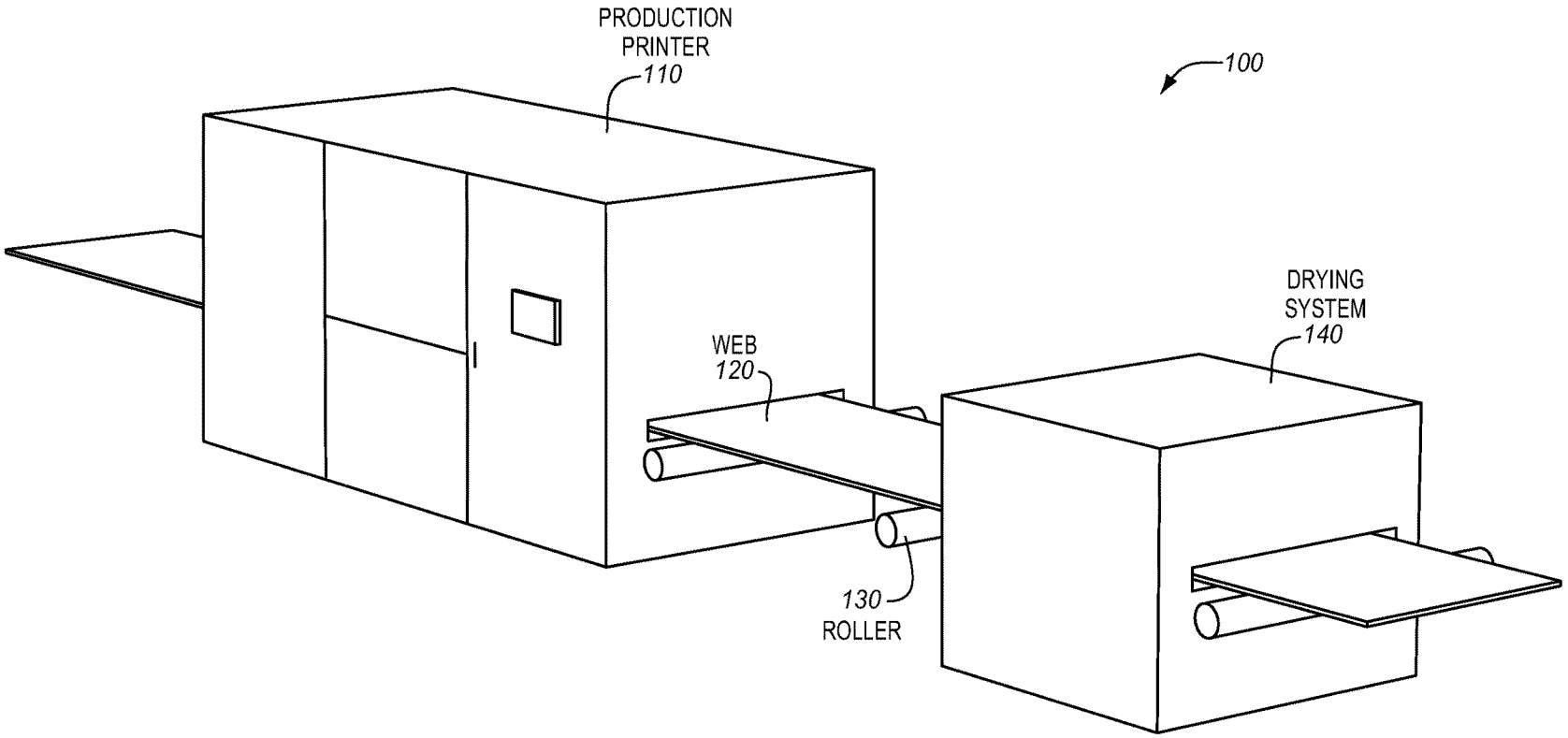
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or clear inks. The ink applied by printer 110 onto web 120 is wet, meaning that the ink may smear if it is not dried before further processing. One or more rollers 130 position web 120 as it travels through printing system 100. Printing system 100 also includes drying system 140, which is any system, apparatus, device, or component operable to dry ink applied to web 120. Printer 110 is upstream from the dryer since web 120 travels downstream from printer 110 to drying system 140. Printer 110 and drying system 140 may be separate devices or one integrated device.

Figure 2:
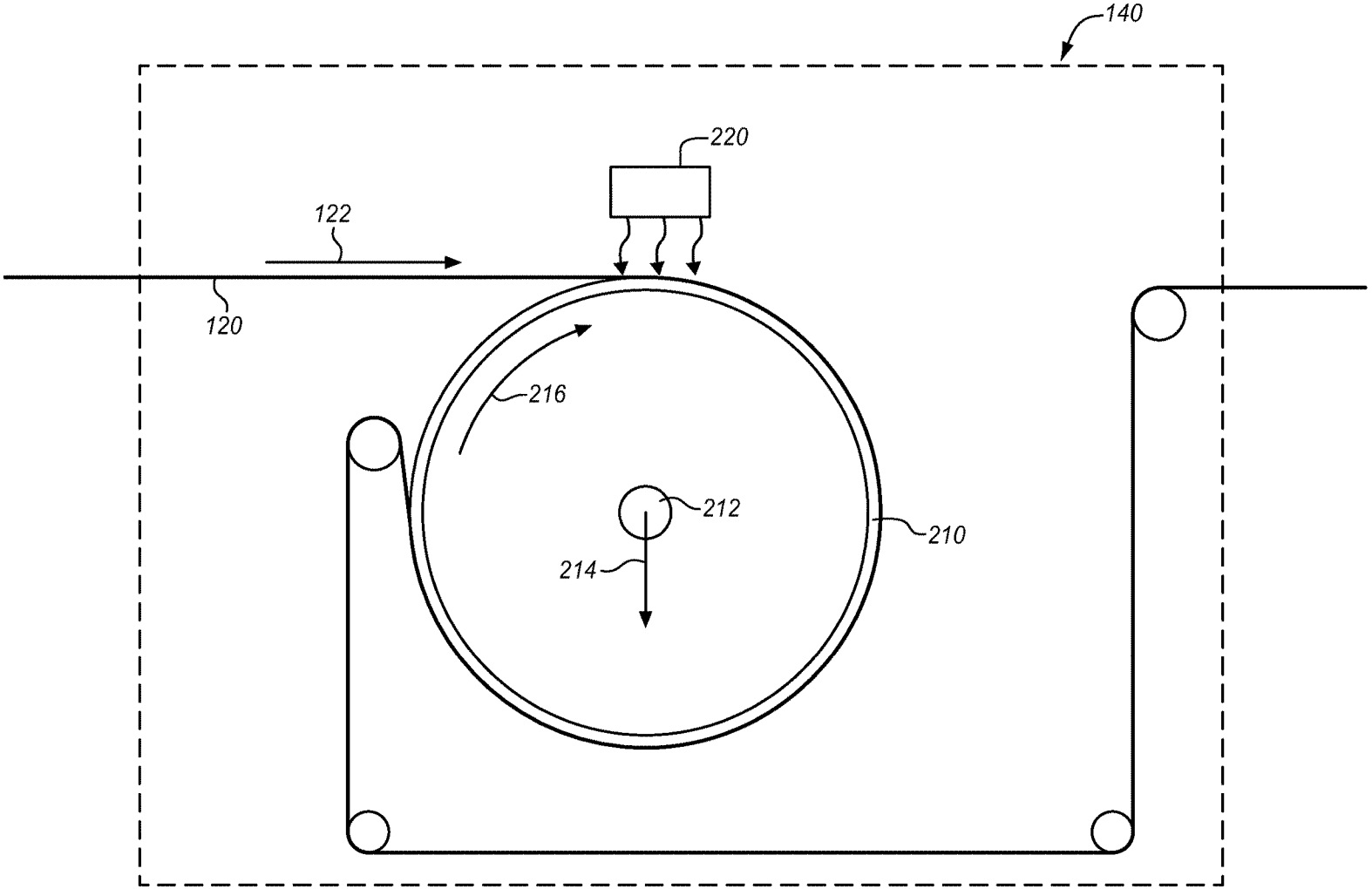
FIG. 2 illustrates a cross-sectional side view of a drying system in an exemplary embodiment.

FIG. 2 illustrates a cross-sectional side view of drying system 140 in an exemplary embodiment. Drying system 140 includes a drum 210 having a cylindrical body with a thermally conductive surface on its outer circumference. During operation, web 120 is marked with ink by a print engine, enters drying system 200 as it travels along web travel direction 122, and wraps around an outer surface of rotating drum 210, which is heated to a desired temperature via heat transfer of a radiant energy source 220 that may be located either internal or external to the drum surface. Drum 210 rotates about axis 212, and components of drying system 200 may therefore be described with respect to a radial direction 214 which is any direction along a straight line from axis 212 or center of drum 210, and a circumferential direction 216 which is analogous to a rotational direction of drum 210 that is perpendicular to radial direction 214.

Figure 3:
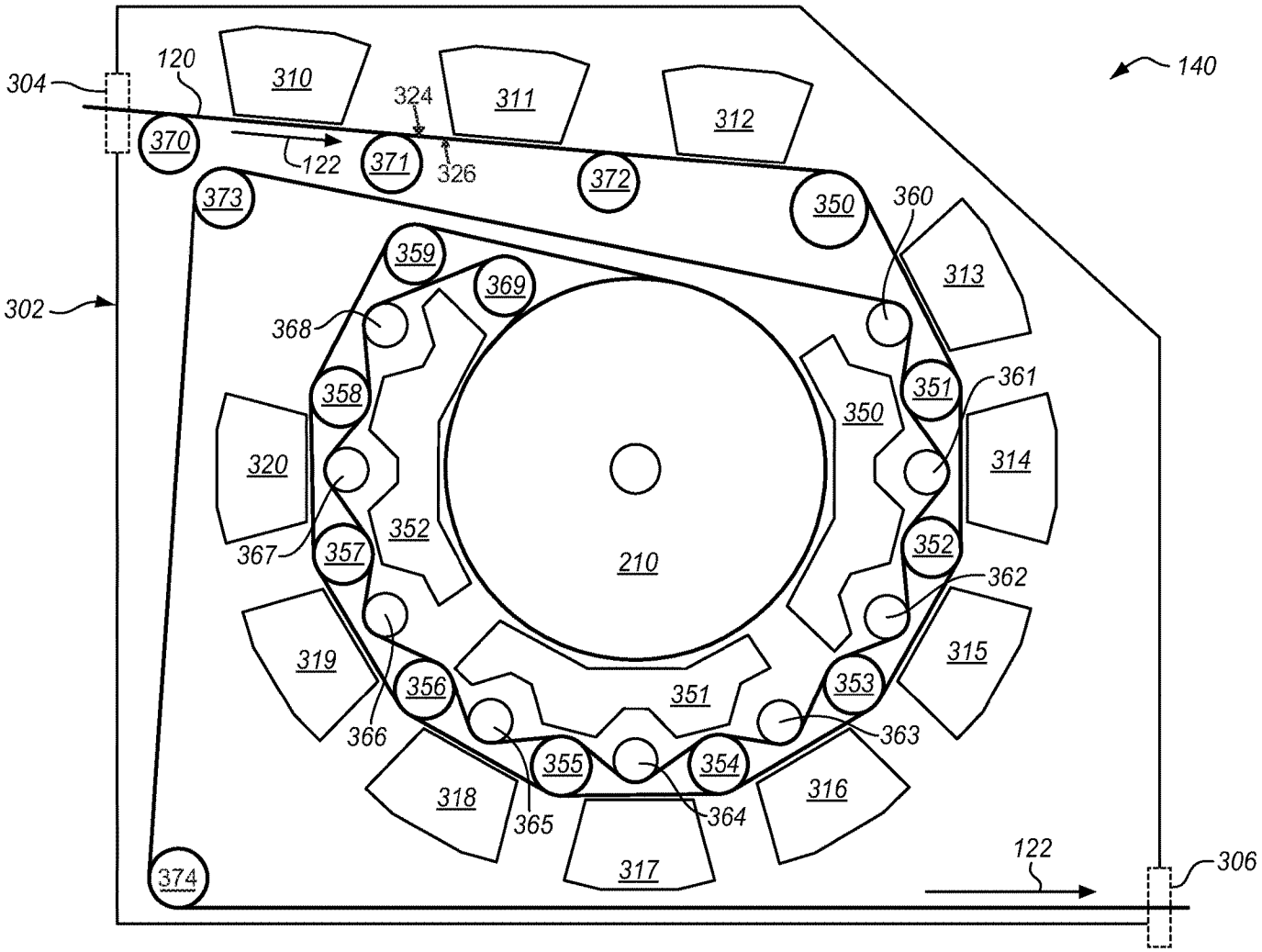
FIG. 3 illustrates a drying system with an enhanced configuration of drying components in an exemplary embodiment.

FIG. 3 illustrates drying system 140 with an enhanced configuration of drying components in an exemplary embodiment. Drying system 140 includes a concentric arrangement of heat components which has advantages in operation of drying system 140 and facilitates an improved duct system as described in greater detail below. In addition to drum 210, drying system 140 includes two groups of rollers: a series of first rollers 350-359 spaced along an arc around drum 210, and a series of second rollers 360-369 positioned inside first rollers 350-359 and spaced along the arc around drum 210. Drum 210 is generally positioned inside the arc from rollers 350-359/360-369 and has a larger circumference than rollers 350-359/360-369. The positioning of rollers 350-359/360-369 generally defines the arc and the path for web 120 to follow inside enclosure 302 of drying system 140. That is, the web path in drying system 140 is a passage for web 120 to follow from dryer entrance 304 to dryer exit 306 and is determined by the engaged surfaces of drum 210 and rollers 350-359/360-369. The web paths are shown in the figures by the line of web 120.

In addition, drying system 140 may include a series of first web conditioners 310-320 positioned outside first rollers 350-359 and spaced along the arc (e.g., along the arc and beyond first rollers 350-359 in radial direction 214 from drum 210). Drying system 140 may also include a series of second web conditioners 350-352 positioned along the arc between second rollers 360-369 and drum 210. Each web conditioner 310-320/350-352 may include one or more radiant energy sources that emit heat energy (e.g., infrared (IR) or near-infrared (NIR) energy), one or more air knives (or other type of positive airflow device) that emit air jets, or some combination thereof.

After printing, web 120 enters an enclosure 302 of drying system 140 at dryer entrance 304 with a marked side 324 that is wet with an applied ink and an unmarked side 326 that does not have ink (or which has been previously marked and already dried). Web 120 may travel over one or more entrance rollers 370-372 before encountering the first rollers 350-359 (and one or more first web conditioners 310-320 (e.g., first web conditioners 310-312) may optionally be positioned over entrance rollers 370-372 which are not arranged along the arc as shown in FIG. 3). The first rollers 350-359 transport (i.e., guide) web 120 along a first path of the arc in a first direction (e.g., clockwise direction or first circular direction). One or more of the first rollers 350-359 may include a thermally conductive surface which may be heated internally via radiant energy sources inside the circumference of first rollers 350-359 and/or heated externally (e.g., via heat of first web conditioners 310-320) for drying ink applied to web 120. The first web conditioners 310-320 may include air knives that emit air jets toward the marked side 324 of web 120 as web 120 travels along the arc toward drum 210 or an alternate method or providing airflow to the marked side 324 of web 120. First web conditioners 310-320 therefore direct energy, or web conditioning (e.g., radiant heat, jetted air, or some combination thereof) toward a portion of the web path that is between the dryer entrance 304 and drum 210. A roller (e.g., roller 359) among the first rollers 350-359 which is last along the arc turns web 120 toward drum 210. Web 120 then wraps around a circumferential portion drum 210 which applies further heat to web 120.

Second web conditioners 350-352 may also include air knives that emit air jets toward the marked side 324 of web 120 as web 120 wraps around drum 210. Alternatively or additionally, the air knives may emit air jets toward the marked side 324 of web 120 as web 120 travels over second rollers 360-369. In alternative embodiments, second web conditioners 350-352 may include one or more radiant energy sources that emit heat energy toward the marked side 324 of web 120 as web 120 wraps around drum 210. Alternatively or additionally, the radiant energy sources may emit heat energy toward the marked side 324 of web 120 as web 120 travels over second rollers 360-369. Thus, second web conditioners 350-352 may direct web conditioning (e.g., radiant heat, jetted air, or some combination thereof) toward a portion of the web path that wraps around drum 210 and/or direct web conditioning toward a portion of the web path that is between the dryer entrance 304 and drum 210.

After traveling around drum 210, web 120 encounters the second rollers 360-369. A roller (e.g., roller 369) among the second rollers 360-369 which is first to receive web 120 from drum 210 may be positioned adjacent to the last roller (e.g., roller 359) of the first rollers 350-359. Accordingly, rollers 369/359 may transport or guide web 120 around a substantial circumferential portion of drum 210 (e.g., wrap/contact angle of 300 degrees or more). The second rollers 360-369 transport web 120 along a second path of the arc in a second direction which is generally opposite from the first direction (e.g., counter-clockwise direction or a second circular direction opposite to the first circular direction). After traveling the arc again in the reversed direction, web 120 may travel over one or more exit rollers 373-374 before leaving drying system 140 through dryer exit 306 of enclosure 302.

In this configuration with rollers 350-359/360-369 and web conditioners 310-320/350-352 in curved, spiral-like patterns around drum 210, there is an increased path length of web 120 inside dryer 140 and also an increased number of options for conditioning web 120 with precise control in comparison with conventional drum dryers. As shown in FIG. 3, drum 210 may be positioned at or near a relative center of enclosure 302 and components are positioned along concentric arcs around drum 210 which are spaced from one another in the radial direction 214. The first arc closest to drum 210 includes second web conditioners 350-352, the second arc includes second rollers 360-369, the third arc includes first rollers 350-359 (e.g., centers of the second rollers 360-369 closer to drum 210 than centers of the first rollers 350-359), and the fourth arc is furthest from drum 210 and includes first web conditioners 310-320. Each arc may span a substantial circumferential portion of drum 210 (e.g., 270 degrees or more). The arc(s) may also comprise semi-circle or circular shaped paths that have a uniform distance from the circumference of drum 210 and/or to other arcs as shown in FIG. 3. However, alternative arc span amounts, non-uniform arc paths, non-circular arc paths, and combinations of different arcs are possible within drying system 140. Additionally, drying system 140 may implement a different number or combination of components in arc(s) other than that explicitly shown and described.

Figure 4:
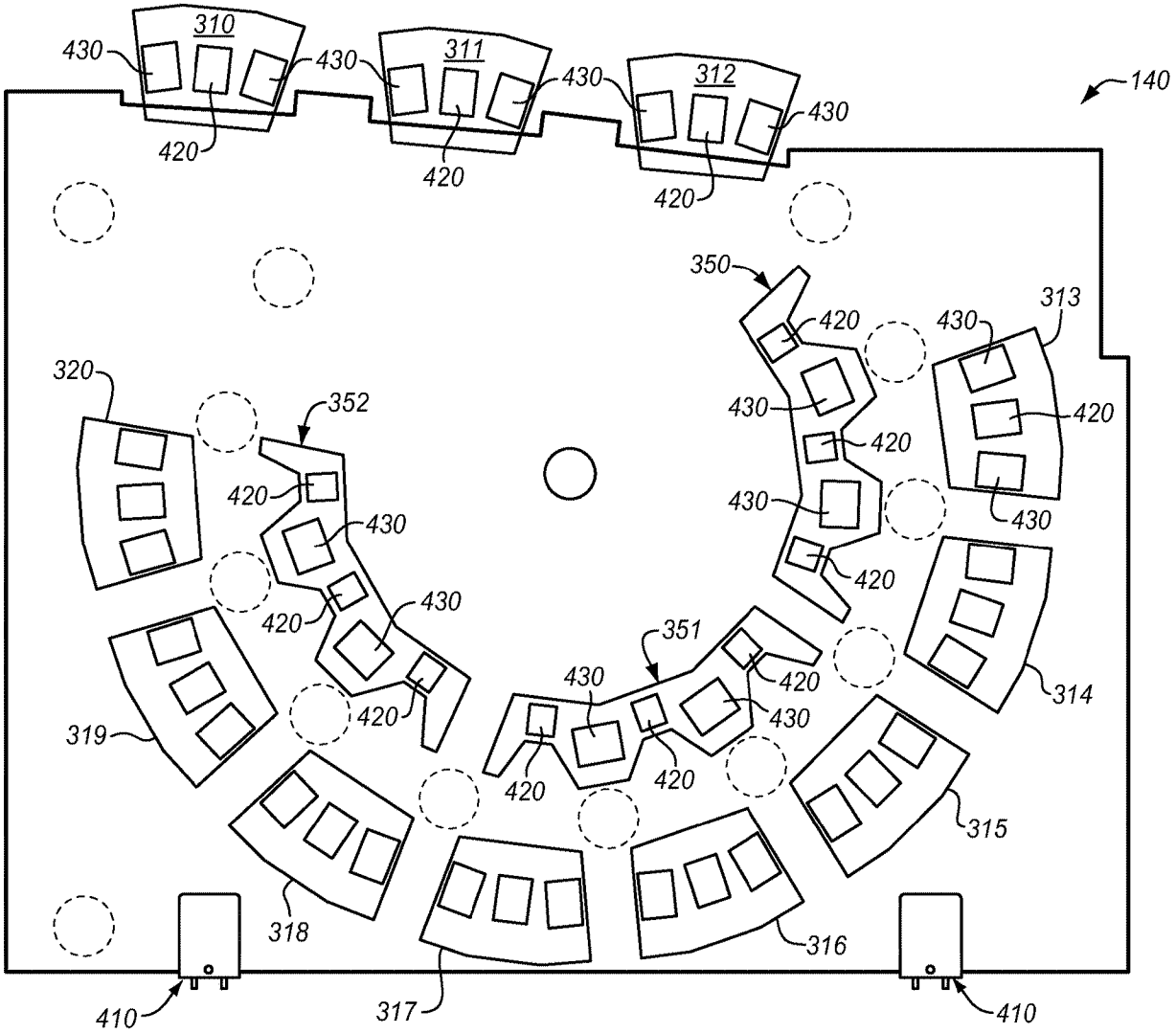
FIG. 4 illustrates air intake and outlet ports of a drying system in an exemplary embodiment.

FIG. 4 illustrates air intake and outlet ports of drying system 140 in an exemplary embodiment. The configuration of airflow components inside dryer 140 is similar to that already described above. As shown in FIG. 4, each web conditioner 310-320/350-352 includes one or more intake ports 420 and one or more outlet ports 430. Intake ports 420 define a passage for air from an external supply into an area inside and/or proximate to web conditioner 310-320/350-352. Outlet ports 430 define a passage for air from an area inside and/or proximate to web conditioner 310-320/350-352 to a return source external to drying system 140. Outlet ports 430 remove air from drying system 140 to prevent oversaturation of evaporated carrier fluid.

Each web conditioner 310-320/350-352 may include a housing that surrounds its components with at least one intake port 420 and at least one outlet port 430 on a side or surface of the housing that act as supply/return vents for the web conditioner 310-320/350-352. Previous supply/return sources of air for dryers of printing systems are implemented inside a cabinet placed outside the dryer on the floor of the print shop (e.g., in a plane along feet 410 of drying system 140 that support drying system 140 on the floor). As described in greater detail below, the concentric arrangement of components inside drying system 140 enables an improved duct system for web conditioners 310-320/350-352. It will be appreciated, however, that drying system 140 shown and described with respect to FIGS. 3-4 is just one exemplary configuration and that alternative arrangements of web conditioners 310-320/350-352, intake ports 420, and outlet ports 430 may realize advantages of an enhanced duct system operable with drying system 140.

Figure 5:
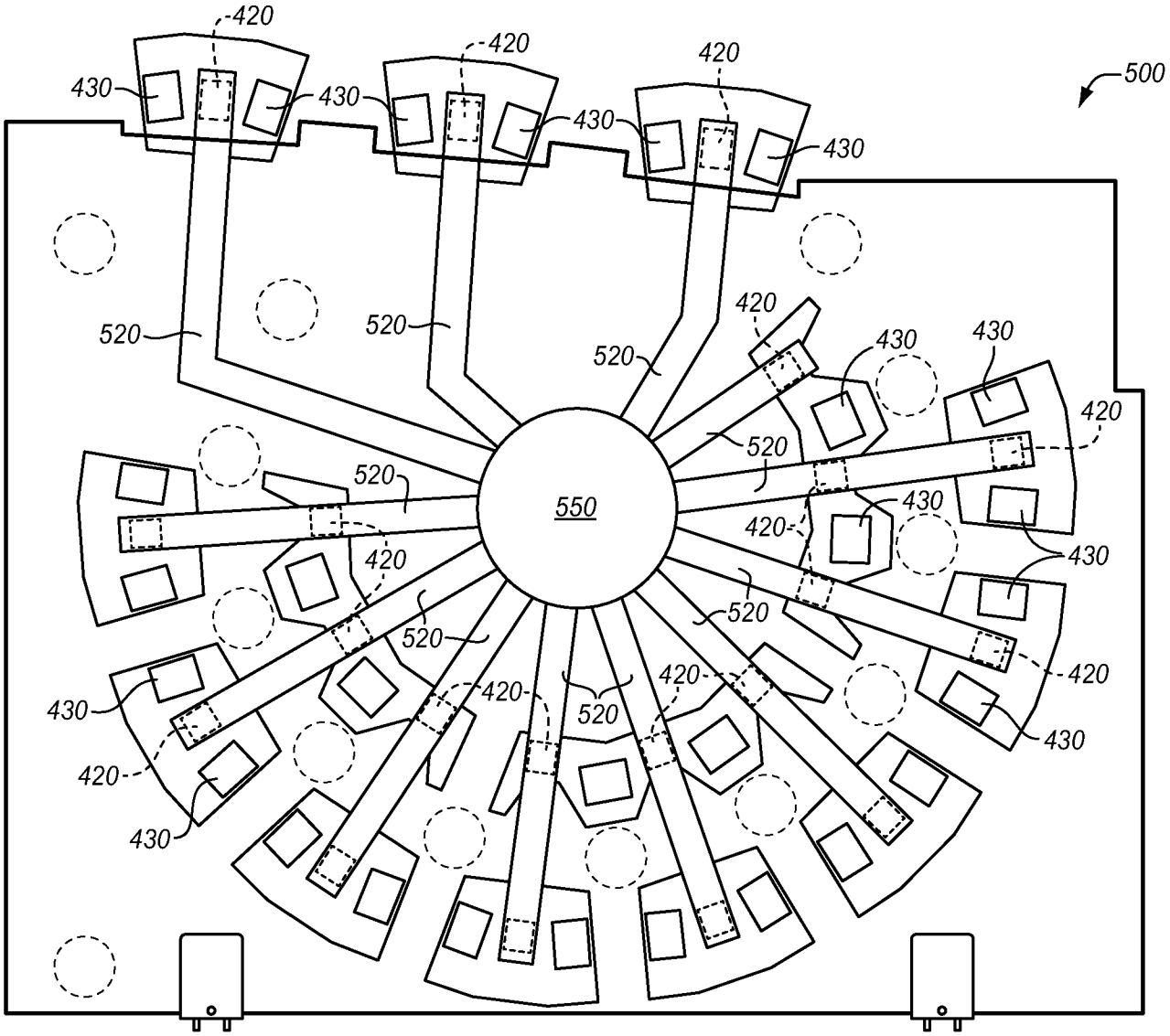
FIG. 5 illustrates an air supply system for air intake ports of a drying system in an exemplary embodiment.

FIG. 5 illustrates an air supply system 500 for air intake ports 420 of drying system 140 in an exemplary embodiment. Air supply system 500 includes a supply hub 550 and a plurality of supply ducts 520 attached around a perimeter or circumference of supply hub 550. Supply hub 550 is configured to provide forced air and supply ducts 520 are configured to distribute the forced air to intake ports 420 of web conditioners 310-320/350-352. Supply hub 550 may comprise a supply plenum that includes and/or attaches with a blower and/or heating equipment such that supply hub 550 may supply forced heated air of a desired temperature via the air channels of supply ducts 520. Supply hub 550 may be positioned at or near a relative center with respect to a side of enclosure 302 of drying system 140. That is, centers of supply hub 550 and drum 210 may align or be substantially aligned in overlapping fashion in radial direction 214 such that supply hub 550 and/or drum 210 occupy a center area with respect to a side of drying system 140 as shown in FIG. 5.

As shown in FIG. 5, the concentric arrangement of one or more web conditioners 310-320/350-352 inside drying system 140 enables one supply duct 520 to connect with multiple intake ports 420 belonging to different web conditioners 310-320/350-352. For example, one supply duct 520 extending in a straight or substantially straight line from supply hub 550 along radial direction 214 may connect with an intake port 420 of a second web conditioner 350-352 in an inner arc position and also connect with an intake port 420 of a first web conditioner 310-320 in an outer arc position. However, some supply ducts 520 may include bent air channels and/or connect with a single intake port 420 as shown in FIG. 5. In any case, supply hub 550 is able to provide air to web conditioners 310-320/350-352 with relatively fewer ducts each with relatively short air path lengths to minimize flow losses and pressure drops for more efficient distribution of air inside drying system 140. The configuration also enables improved modularity of ducts as described in greater detail below.

Figure 6:
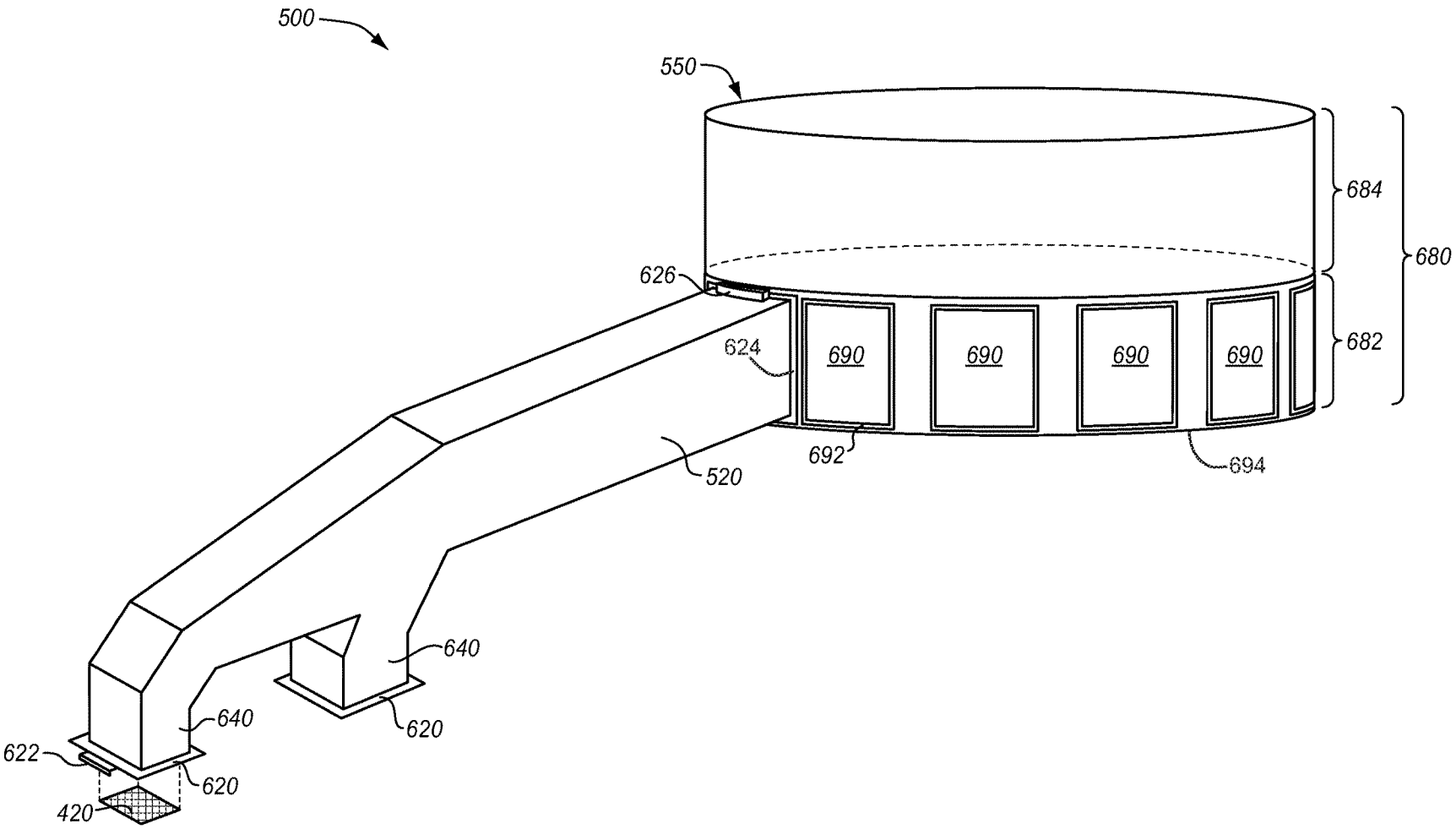
FIG. 6 illustrates a perspective view of an air supply system in an exemplary embodiment.

FIG. 6 illustrates a perspective view of air supply system 500 in an exemplary embodiment. As shown in FIG. 6, supply hub 550 may include a tubular body 680 with a lower portion 682 and an upper portion 684. Tubular body 680 is any hollow, ring-like structure and may include a circular structure as shown in FIG. 6 or a polygon shape with flat sides that attach (e.g., removably or non-removably) together to form the structure. Lower portion 682 includes a plurality of supply nodes 690 that define hollow spaces around its perimeter or circumference for air passage from supply hub 550 to supply ducts 520. In one embodiment, distal axial end 694 of lower portion 682 is closed to prevent air passage through distal axial end 694 of lower portion 682. In another embodiment, distal axial end 694 of lower portion 682 has an opening (e.g., one or more holes and/or slots) to provide air passage through distal axial end 694 of lower portion 682.

Supply ducts 520 each include a structure that is hollow for air passage from a base end 624 coupled with supply node 690 to one or more distal ends 620 coupled with intake ports 420 of web conditioner 310-320/350-352 inside drying system 140. In that regard, supply duct 520 may include branches 640 that divide the air supply from the main body of supply duct 520 into multiple distal ends 620.

Supply duct 520 may comprise dimensions (e.g., length, shape, etc.) such that base end 624 aligns/couples with supply node 690 and distal end(s) 620 align/couple with intake port(s) 420. In other words, each supply duct 520 may be sized for a base end 624 to align with a supply node 690 (e.g., at an appropriate alignment location/shape along circumferential direction 216 relative to supply hub 550) and for one or more distal ends 624 to align with one or more intake ports 420 (e.g., at an appropriate alignment location/shape along radial direction 214 relative to supply hub 550). Accordingly, supply ducts 520 may include a rigid body (e.g., sheet metal, cast metal, etc.) which is adapted to the configuration of web conditioner 310-320/350-352 (and corresponding intake ports 420) inside drying system 140 and which is removably attached at supply hub 550 and/or intake ports 420 inside drying system 140. Supply ducts 520 may alternatively or additionally include flexible tube material for flexibly attaching to intake ports 420.

For supply ducts 520 with branches 640 and multiple distal ends 620, the relative position between distal ends 620 may facilitate alignment/coupling between base end 624 and an appropriate supply node 690 of supply hub 550 as well as alignment/coupling between one distal end 620 of supply duct 520 and an intake port 420 at a first distance along radial direction 214 and also alignment/coupling between another distal end 620 of supply duct 520 and a different intake port 420 (e.g., of a different web conditioner 310-320/350-352) at a second distance along radial direction 214 that is larger than the first distance. Additionally, one or more supply ducts 520 may be interchangeable with other supply ducts 520 operable to connect to supply hub 550. Referring to FIG. 5 for an example, supply ducts 520 extending from supply hub 550 to intake ports 420 of web conditioners 313-320 (which also connect with intake ports 420 of web conditioners 350-352) may each include an interchangeable design similar to the shown in FIG. 6. That is, a portion of supply ducts 520 may have similar or equal dimensions and/or lengths along radial direction 214 such that the appropriate supply node 690 and intake ports 420 are coupled regardless as to which particular supply duct 520 is used. Other ducts 520, such as those used for web conditioners 310, 311, 312, and first intake port 420 of web conditioner 350, may have unique dimensions operable for a particular supply node 690 of supply hub 550 (or for a particular location along circumferential direction 216 relative to supply hub 550).

To couple supply duct 520 with supply node 690, each supply node 690 may include a gasket 692 that borders or lines the shape of an aligned contacting surfaces (e.g., rectangular or some other shape) between supply node 690 and base end 624 of supply duct 520 to seal the connection thereof. Each supply node 690 may further include one or more latches 626 or other mechanical fasteners for removably attaching base end 624 of supply duct 520 to supply node 690 of supply hub 550. For instance, base end 624 may include a flange or rim that may be levered into a sealed connection via one or more latches 626. Alternatively or additionally, gasket lined connections, latches 626, etc. may be included at base end 624 of supply duct 520. Also, one or more supply nodes 690 may include a plug that covers/seals supply node 690 for instances in which supply node 690 is not used or does not couple with a supply duct 520. This allows supply ducts 520 to be selectively installed around supply hub 550 according to the desired configuration of components in drying system 140.

To couple supply duct 520 with intake port 420, each distal end 620 may include one or more latches 622 for removably attaching to intake port 420 of web conditioners 310-320/350-352. Distal end 620 and/or intake port 420 may additionally or alternatively include flanges, gasket lined connections, and/or other fastener means similar to that already described to seal supply duct 520 and intake port 420 for passage of air from supply hub 550 to the housing of a web conditioner 310-320/350-352. Accordingly, each supply duct 520 may connect supply hub 550 with one or multiple intake ports 420 of drying system 140 so that air is supplied efficiently over a few number of shorter supply ducts 520 which may be easily attached and detached from supply hub 550 and components of drying system 140. Furthermore, supply ducts 520 may be broken into parts to facilitate ease of installation while maintaining accurate connection points to intake ports 420 of the airflow components of web conditioners 310-320/350-352. For instance, one or more pieces of a supply duct 520 may be assembled together with one or more interface plates (e.g., a surface with guiding walls for mounting), bolts, latches, etc. Alternatively or additionally, a portion of a supply duct 520 may be sized such that a direct current (DC) fan may be integrated into supply duct 520 in embodiments in which a positively pressured blower is not included in air supply system 500. Fans may be removably attached to supply ducts 520 so that the fans may be replaced when it is desired to use a blower or another external positive airflow source for dryer applications that use higher temperatures and/or flow rates. Supply duct 520 may include sealable cutouts near attachment points for fans to facilitate attachment and removal for switching depending on the availability and/or desirability of external air supply sources.

Figure 7:
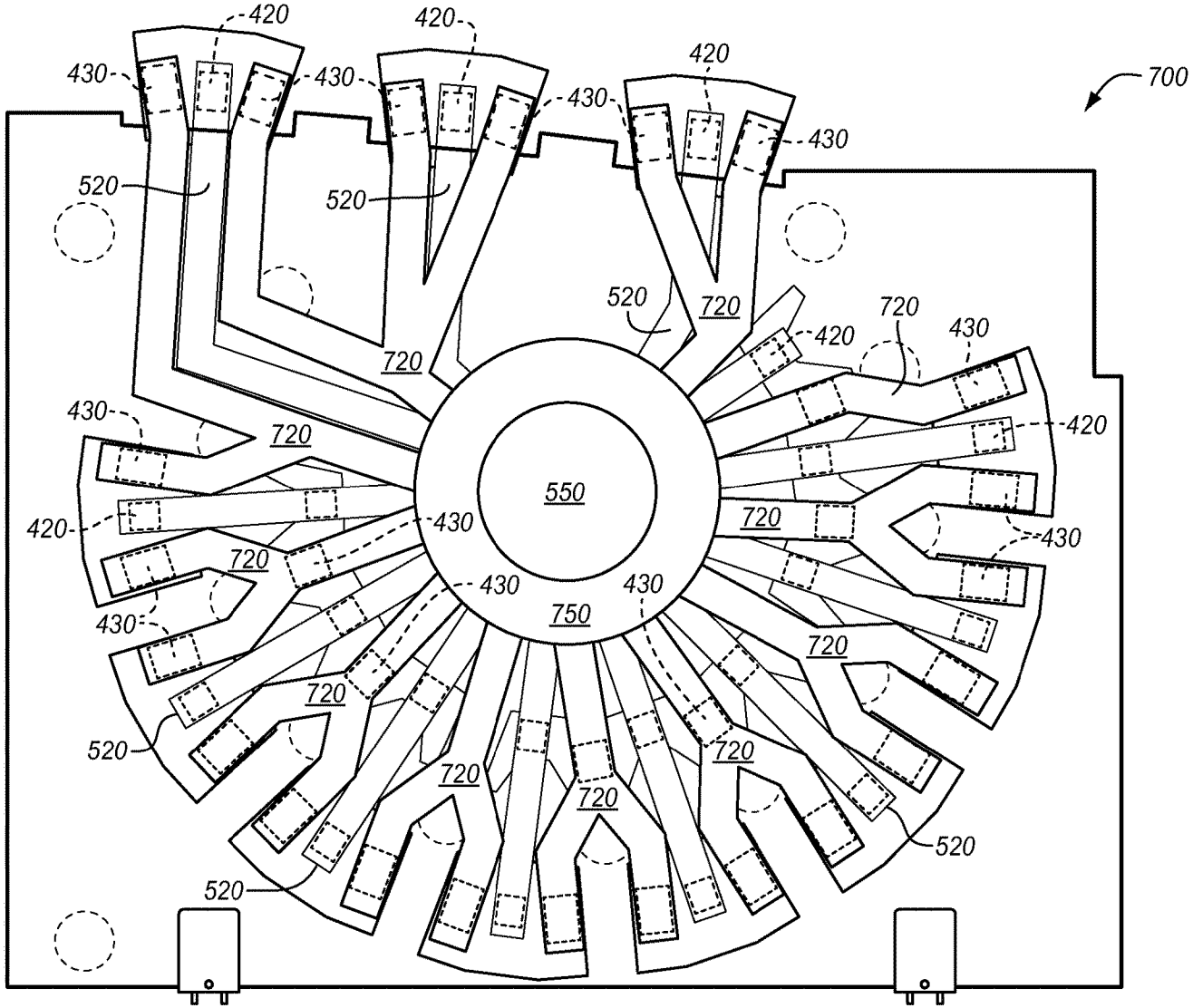
FIG. 7 illustrates a duct system with a concentric return hub and supply hub for a drying system in an exemplary embodiment.

FIG. 7 illustrates a duct system 700 with a concentric return hub 750 and supply hub 550 for drying system 140 in an exemplary embodiment. Duct system 700 includes supply system 500 already described above and also includes a return system including return hub 750 and a plurality of return ducts 720. Return hub 750 is concentrically positioned with respect to supply hub 550 and is configured to suction air from outlet ports 430 of web conditioners 310-320/350-352 via air paths defined by return ducts 720. Return hub 750 may comprise a return plenum that draws exhaust and used air from drying system 140 back into the blower and/or heating equipment of supply hub 550 for recirculation of heated forced air. Return hub 750 may also include one or more filters to remove particles/exhaust from the air.

Return ducts 720 may attach around a perimeter or circumference of return hub 750 to connect return hub 750 with outlet ports 430 of web conditioners 310-320/350-352. One return duct 720 may connect return hub 750 with multiple outlet ports 430 along radial direction 214. For example, a return duct 720 may extend from return hub 750 in radial direction 214 to connect an outlet port 430 of a second web conditioner 350-352 in an inner arc position and also connect to an outlet port 430 of a first web conditioner 310-320 in an outer arc position. However, some return ducts 720 may include bent air channels, may connect with a single outlet port 430 and/or web conditioner 310-320/350-352, and/or may connect with multiple outlet ports 430 of the same web conditioner 310-320/350-352 as shown in FIG. 7. Regardless of the particular configuration of drying system 140 (including the particular arrangement of web conditioner 310-320/350-352, intake ports 420, outlet ports 430, etc.), duct system 700 is able to circulate air to and from web conditioners 310-320/350-352 with relatively fewer ducts each with relatively short air path lengths to minimize flow losses and pressure drops for more efficient distribution of air inside drying system 140.

Figure 8:
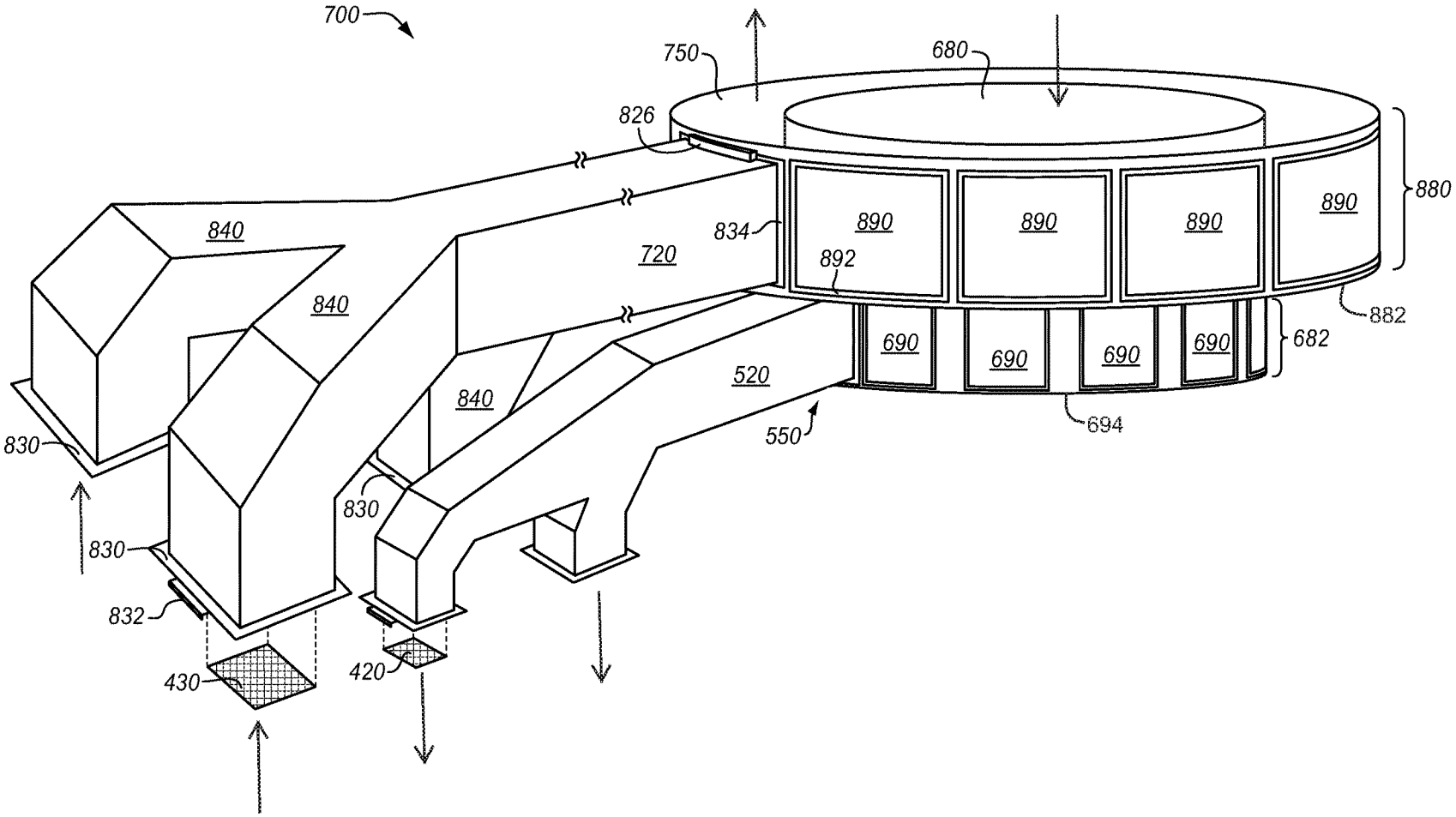
FIG. 8 illustrates a perspective view of a duct system for a drying system in an exemplary embodiment.

FIG. 8 illustrates a perspective view of duct system 700 for drying system 140 in an exemplary embodiment. As shown in FIG. 8, return hub 750 may include a ring-like upper portion 880 that fits around the upper portion 684 (not shown in FIG. 8) of the tubular body 680 of supply hub 550 (leaving the lower portion 682 of supply hub 550 and corresponding supply nodes 690 exposed for coupling with supply ducts 520 along a lower plane than a plane of return nodes 890 with respect to a distance from the side of drying system 140). A floor 882 of upper portion 880 extends between an outer perimeter or circumference of upper portion 880 and an outer perimeter or circumference of tubular body 680 to confine air in upper portion 880 and prevent air passage from going vertical down within upper portion 880. Distal axial end of the lower portion 682 may be removably attached to a side of drying system 140 to support assembly of supply hub 550 and return hub 750 in a concentric, stacked configuration on a side of drying system 140 off the floor of the print shop to minimize the footprint of duct system 700 in the print shop that operates printing system 100. The layered configuration of return hub 750 and supply hub 550 also improves heat transfer therebetween while supplying/removing air to all web conditioners 310-320/350-352 via intake ports 420 and outlet ports 430 of drying system 140 with minimal heat loss through ducts 520/720.

The air return system of duct system 700 includes many similarities with air supply system 500 already described above, including a plurality of supply nodes 890 that define hollow spaces around a perimeter or circumference of upper portion 880 of return hub 750 for air passage from return ducts 720 to return hub 750. Each return duct 720 includes a structure that is hollow for air passage from one or more distal ends 830 coupled with outlet ports 430 to a base end 834 coupled with return node 890. Return ducts 720 may include branches 840 that combine air from multiple distal ends 830 into the main body of return duct 720 to circulate air from drying system 140 back to return hub 750 via return node 890. As such, return ducts 720 may be sized to align/couple base end 834 with return node 890 and to align/couple one or more distal ends 830 with one or more outlet ports 430 (similar to that described for supply ducts 520, supply nodes 690, and intake ports 420). Alternatively or additionally to branching along radial direction 214, the relative positon between distal ends 830 may facilitate alignment/coupling with multiple outlet ports 430 of the same web conditioner 310-320/350-352 (e.g., branch along circumferential direction 216 relative to supply hub 550). Return ducts 720 may include a rigid body (e.g., sheet metal) adapted to the configuration of web conditioner 310-320/350-352 (and corresponding outlet ports 430) inside drying system 140, and/or may include flexible tube material for flexibly attaching to outlet ports 430. One or more return ducts 720 may be interchangeable with other return ducts 720 operable to connect to return hub 750, similar to that already described for supply ducts 520 and supply hub 550.

To couple return duct 720 with return node 890, each return node 890 may include a gasket 892 that lines the shape of appropriately aligned and connecting surfaces (e.g., rectangular or some other shape) between return node 890 and base end 834 of return duct 720 to seal the connection thereof. Each return node 890 may further include one or more latches 826 or other mechanical fasteners for removably attaching base end 834 of return duct 720 to return node 890 of return hub 750. For instance, base end 834 may include a flange or rim that may be levered into a sealed connection via latch 826. Alternatively or additionally, gasket lined connections, latches 826, etc. may be included at base end 834 of return duct 720. Also, one or more return nodes 890 may include a plug that covers/seals supply node 890 for instances in which supply node 890 is not used or does not couple with a return duct 720. This allows return ducts 720 to be selectively installed around return hub 750 according to the desired configuration of drying system 140. Return ducts 720 may also include multiple attachable/detachable pieces similar to that described above for supply ducts 520 to facilitate ease of installation while maintaining accurate connection points to outlet ports 430 of the airflow components of web conditioners 310-320/350-352. Return ducts 720 may be sized to match the total overall airflow volume. For example, if return ducts 720 connect to a fewer number of outlet ports 430 (e.g., three total), the size of each return ducts 720 may be larger with tapered ends so that it is still sized to connect to individual outlet ports 430 and return nodes 890.

To couple return duct 720 with outlet port 430, each distal end 830 may include a latch 832 for removably attaching to outlet port 430 of web conditioners 310-320/350-352. Distal end 300 and/or outlet port 430 may additionally or alternatively include flanges, gasket lined connections, and/or other fastener means similar to that already described to seal return duct 720 and outlet port 430 for passage of air from web conditioner 310-320/350-352 to return hub 750. Each return duct 720 may connect return hub 750 with one or multiple outlet ports 430 of drying system 140 so that air is distributed efficiently over a few number of shorter return ducts 720 which may be easily attached and detached from return hub 750 and components of drying system 140. This configuration also enables supply hub 550 and return hub 750 to be easily assembled and disassembled for maintenance of duct system 700 and/or drying system 140.

In one embodiment, distal axial end 694 of lower portion 682 has an opening (e.g., one or more holes and/or slots) to supply air near drum 210 and/or components that heat drum 210. Alternatively or additionally, low points in return hub 750 and/or return ducts 720 may include drain ports to drain/collect condensation build up from vaporized ink carrier fluid. In another embodiment, dampers may be integrated into supply ducts 520 and/or return ducts 720 to restrict/expand air flow at particular locations according to desired balance of air flow in drying system 140. Alternatively or additionally, dampers may be integrated into supply hub 550 and/or return hub 750 to focus airflow. In yet another embodiments, fins located between supply hub 550 and return hub 650 may further improve heat transfer. It will be appreciated that alternative concentric/stacked configurations of supply hub 550 and return hub 750, including a switched stack/concentric positional relationship, different shapes, relative sizes, etc. are possible for enhancing air distribution in drying system 140 with duct system 700 other than that explicitly shown and described in FIGS. 7-8.

Figure 9:
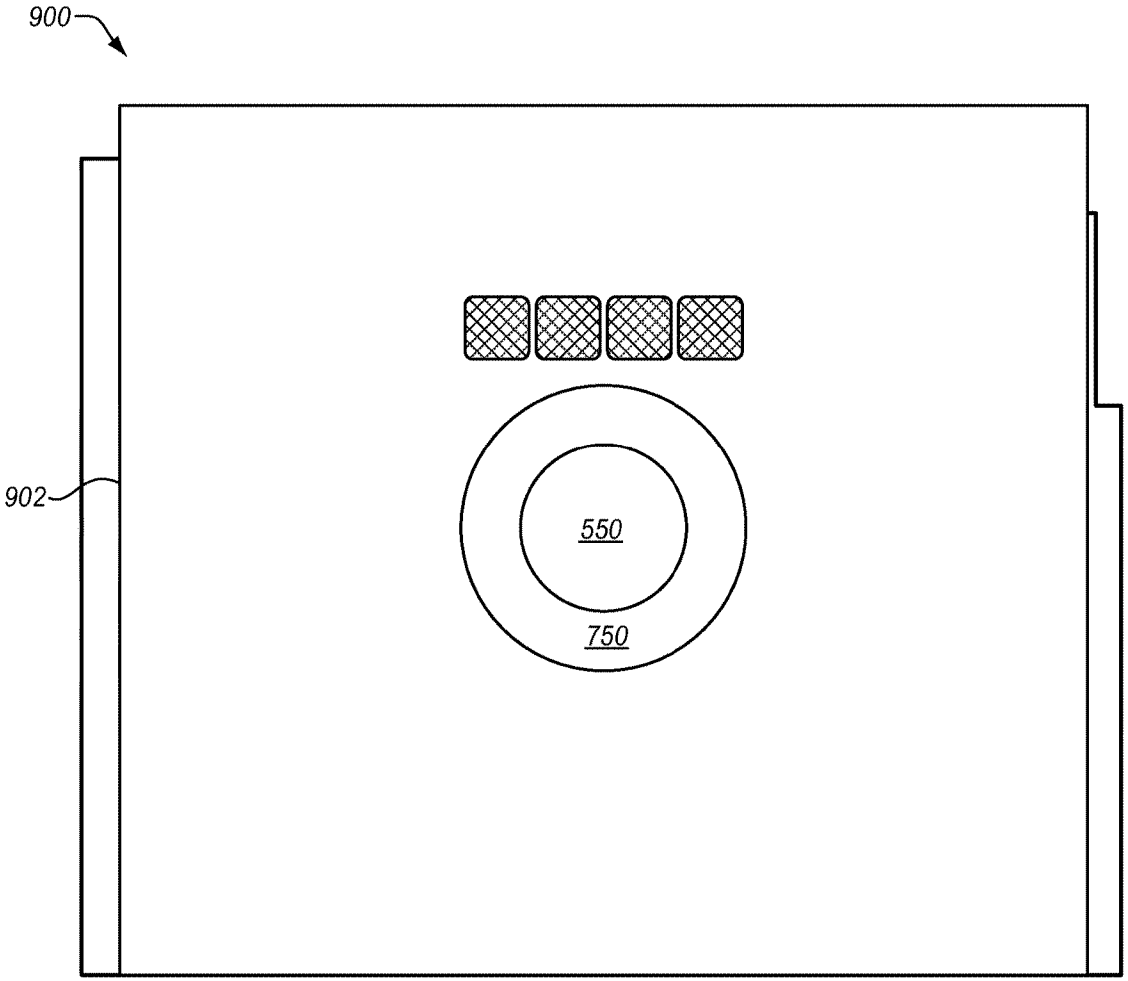
FIG. 9 illustrates a side view of a drying system enhanced with a duct system in an exemplary embodiment.

FIG. 9 illustrates a side view 900 of a drying system 140 enhanced with duct system 700 in an exemplary embodiment. The side of drying system 140 includes a cover 902

(which may be part of enclosure 302) that surrounds/seals the internal environment of drying system 140 and obscures internal components of drying system 140 and ducts 520/720. At a connection point on the side of drying system 140 where supply hub 550 and return hub 750 may be removably attached to one another and the side of drying system 140, enclosure 902 may include a cut out (which may be sealed) to provide external access to supply hub 550 and return hub 750 as well as access to supply/exhaust passages of drying system 140). The assembled, stacked configuration of supply hub 550 and return hub 750 allows duct system 700 to be installed as a low-profile configuration that is attached to a side of drying system 140 off the floor of the print shop.

The particular arrangement, number, and configuration of components described herein is exemplary and non-limiting. Although specific embodiments were described herein, the scope of the inventive concepts is not limited to those specific embodiments. The scope of the inventive concepts is defined by the following claims and any equivalents thereof.

What is claimed is:

1. A system comprising:

a dryer of a printing system comprising:

web conditioners configured to condition a web of print media;

intake ports configured to supply air for the web conditioners; and outlet ports configured to remove air for the web conditioners; and a duct system for the dryer comprising:

a supply hub including a tubular body with a lower portion and an upper portion, and including supply nodes around the lower portion;

a return hub including a body around the upper portion of the supply hub, and including return nodes around the body;

supply ducts configured to connect the supply nodes and the intake ports of the dryer; and return ducts configured to connect the return nodes and the outlet ports of the dryer.

2. The system of claim 1 wherein:

the supply hub and the return hub are positioned concentrically with one another on a side of the dryer; and the supply hub and the return hub occupy a center of the side of the dryer.

3. The system of claim 2 wherein:

the supply ducts each comprise a rigid body with a first end configured to removably attach to a supply node on the supply hub, and a second end configured to removably attach to one of the intake ports of the dryer; and the return ducts each comprise a rigid body with a first end configured to removably attach to a return node on the return hub, and a second end configured to removably attach to one of the outlet ports of the dryer.

4. The system of claim 3 wherein:

one or more supply ducts branch into multiple second ends configured to removably attach to multiple intake ports spaced in a radial direction within the dryer.

5. The system of claim 4 wherein:

the multiple intake ports belong to different web conditioners within the dryer.

6. The system of claim 3 wherein:

one or more return ducts branch into multiple second ends configured to removably attach to multiple outlet ports spaced in a radial direction within the dryer.

7. The system of claim 6 wherein:

the multiple outlet ports belong to different web conditioners within the dryer.

8. The system of claim 2 wherein:

the dryer includes a rotating drum; and the supply hub includes an opening on an axial end of the lower portion of the supply hub configured to supply air near the center of the side of the dryer.

9. The system of claim 1 further comprising:

a gasket that borders around each of the supply nodes to seal connections with a base end of an aligned supply duct; and a gasket that borders around each of the return nodes to seal connections with a base end of an aligned return duct.

10. The system of claim 1 further comprising:

a printer to apply wet colorants to the web of print media.

11. The system of claim 1 further comprising:

an enclosure configured to surround the dryer wherein the enclosure provides external access to the supply hub and the return hub.

12. An apparatus comprising:

a supply hub including a tubular body with a lower portion and an upper portion, and including supply nodes around the lower portion, the supply hub configured to provide air to intake ports of a dryer applying airflow to a web of print media;

a return hub including a body around the upper portion of the supply hub, and including return nodes around the body, the return hub configured to receive air from outlet ports of the dryer;

supply ducts configured to connect the supply nodes of the supply hub and the intake ports of the dryer; and return ducts configured to connect the return nodes of the return hub and the outlet ports of the dryer.

13. The apparatus of claim 12 wherein:

the return hub is stacked on top of the supply hub in a concentric configuration;

the return ducts are configured to attach to the return nodes around a circumference of the return hub in a first plane that overlaps with the upper portion of the supply hub; and the supply ducts are configured to attach to the supply nodes around a circumference of the supply hub in the lower portion in a second plane that is below that first plane.

14. The apparatus of claim 13 further comprising:

latches to removably attach the return ducts with the return nodes and the supply ducts with the supply nodes.

15. The apparatus of claim 13 further comprising:

gaskets to seal connections of the return ducts with the return nodes and to seal connections of the supply ducts with the supply nodes.

16. The apparatus of claim 13 wherein:

one or more of the supply ducts include a rigid body that aligns with the supply nodes of the supply hub and multiple intake ports of the dryer; and one or more of the return ducts include a rigid body that aligns with the return nodes of the return hub and multiple outlet ports of the dryer.

17. The apparatus of claim 12 further comprising:

an enclosure configured to surround the dryer wherein the enclosure provides external access to the supply hub and the return hub.

18. A system comprising:

a dryer of a printing system comprising:

web conditioners configured to condition a web of print media;

intake ports configured to supply air for the web conditioners; and outlet ports configured to remove air for the web conditioners; and a duct system for the dryer comprising:

a supply hub with first air passages removably attached around a perimeter of the supply hub configured to removably attach with the intake ports of the web conditioners; and a return hub with second air passages removably attached around a perimeter of the return hub configured to removably attach with the outlet ports of the web conditioners;

wherein the supply hub and the return hub are positioned concentrically with one another on a side of the dryer.

19. The system of claim 18 wherein:

the supply hub is stacked on top of an upper portion of the return hub.

20. The system of claim 18 wherein:

the return hub is stacked on top of an upper portion of the supply hub.

* * * * *